US005667460A

United States Patent [19]

Smith

[11] Patent Number: 5,667,460

[45] Date of Patent: Sep. 16, 1997

[54] BALLISTIC FORCE EXERCISER

[76] Inventor: Robert Samuel Smith, 1263 Emory St., San Jose, Calif. 95126

[21] Appl. No.: 618,685

[22] Filed: Mar. 20, 1996

[51] Int. Cl.[6] ..... A63B 71/00

[52] U.S. Cl. ..... 482/8; 482/94; 482/121

[58] Field of Search ..... 482/1, 4–9, 40, 482/72, 94, 98, 110, 121, 123, 129, 130, 148, 901, 902, 909, 100–103, 112, 134; 73/379.01, 379.02, 379.03, 379.06, 379.08, 379.09; 235/98 R, 91 G

[56] References Cited

U.S. PATENT DOCUMENTS 4,832,332 5/1989 Dumbser ..... 482/8

FOREIGN PATENT DOCUMENTS 3529895 2/1987 Germany ..... 482/101

92/22357 12/1992 WIPO ..... 482/8

*Primary Examiner*—Richard J. Apley
*Assistant Examiner*—John Mulcahy

[57] ABSTRACT

An exerciser for monitoring ballistic force, i.e., the force generated by changing the momentum of a moving object, including a base, an active member movably mounted on the base for movement by a user during exercise from a rest position in which the active member is at rest through a home position to an extended position. A start switch starts a timer when the active member is displaced from the rest position. The timer runs for a timer period. As the active member is moved successively between the home and extended positions a counter switch connected in series with said start switch increments a repetition counter. The distance between the timer and counter switches is adjustable. The number of repetitions performed during the timer period is displayed for the user's information.

10 Claims, 1 Drawing Sheet

BALLISTIC FORCE EXERCISER

FIELD OF THE INVENTION

This invention relates to exercisers and particularly to the type of exerciser where ballistic force is generated by momentum change.

PRIOR ART AND INFORMATION DISCLOSURE

In the context of this specification, the term, ballistic force, is understood to mean the component of force that is generated by momentum change. Static force is understood to mean the force exerted dining the exercise maneuver that is not speed dependent.

For example, slowly lifting a heavy weight incorporates essentially static force. Ballistic force on the legs is generated by the act of jumping off a table wherein the body gains downward momentum during downward flight and a substantial ballistic force is generated when the legs of the user stop and reverse the downward flight. Another example is the extra force that is exerted when a ball is thrown.

There are several examples of exercise apparatus whose use incorporates a large component of ballistic force.

One such example is the medicine ball, a padded heavy ball that a user throws, or catches. Another example is the "leaper" which is a weighted lever whose free end is supported on the shoulders of a crouching athlete who leaps into air when performing the exercise.

An apparatus where exercises are performed that incorporate predominantly static forces is the Smith machine which is a self spotting apparatus manufactured by several companies. The apparatus includes a horizontal weight bar sliding on two vertical uprights with means for temporarily locking the bar at any location along the uprights in order that the athlete may position himself to preform the exercise.

Ballistic force presents two aspects in athletic performance.

One aspect is that application of ballisitic force during an exercise maneuver is an important element in developing strength. Most every exercise maneuver includes a ballistic component of force and a static component of force and the relative degree of each component depends on the exercise. For example, throwing a baseball involves a small component of static force because a baseball is not very heavy and the ballistic component is large because of the speed developed during the throw. In comparison, when lifting a heavy weight, (involving slow motion), the static component of force is large and the ballistic component of force is small.

The second aspect of the ballistic force component in an athletic maneuver is the incidence of injury that occurs because of the sudden application of excessive ballistic force. A prominent example is damage to joints of the leg by the ballistic force generated during sprinting where up to five times the body weight is instantaneously developed when the foot of the sprinter contacts the ground.

A problem with the practice of common exercise maneuvers incorporating large ballistic force is that the ballistic force is typically not measurable. The result is seen in many well known cases where an athlete, who has suffered an injury such as a hamstring pull (Emmit Smith of the Dallas Cowboys) or a ligament tear (Mark Maguire of the Oakland Athletics) thinks he has fully recovered from an injury and then reinjures himself when he resumes training. His injury has healed but he has not recovered his strength. He reinjures himself because he exerts an uncontrolled unmonitored excessive ballistic force that is beyond the ability of the involved muscle group to resist.

SUMMARY

It is an object of this invention to provide apparatus in which exercises can be performed in which ballisitic force can be measured and therefore controlled.

This invention can be practiced in several embodiments. The invention is directed toward an arrangement wherein the active member of an exercise apparatus is initially in a rest position. In the context of this specification, the term, "active member" is understood to mean the part of the apparatus that moves when the athlete is performing his exercise. For example, in a Smith Machine described above, the active member is the weight bar that is slid up and down on the vertical uprights by the athlete. When the active member is moved from its initial position as the athlete starts his set of exercises, a "normally-open" switch closes and thereby initiates a timer to close a timer switch for a preset period of time. A "repetition" switch is positioned at a home position preferably near the "timer" switch and is connected to a counter. At the completion of each repetition during the timer period, the counter switch closes and a count is registered. The number of counts during the timer period indicates the speed with which the exercise is being performed. Ballistic force is generated during a repetition involving reciprocal motion in which the active member is moved from the home position near the rest position to an extended position then back to the home position. In some embodiments, the apparatus is provided with a spring return so that the active member returns from the extended position at a speed that is conserved from speed generated during passage from the home position to the extended position. The Ballistic force generated during a repetition is indicated (measured) by the number of repetitions performed during the timer period.

The invention is incorporated in several embodiments.

In one embodiment, the apparatus is a Smith machine in which the timer switch is secured on the upright at a position where the bar is at rest on the uprights. The counter switch is located on the upright a short distance above the timer switch. A spring return is located on the upright above and distal from the counter switch.

In another embodiment, the apparatus is a leaper in which the switches are positioned in locations corresponding to the locations of the Smith machine.

In another embodiment, the apparatus is a platform that the athlete slides with one foot against resistance.

DESCRIPTION OF BEST EMBODIMENTS

Figure 1:
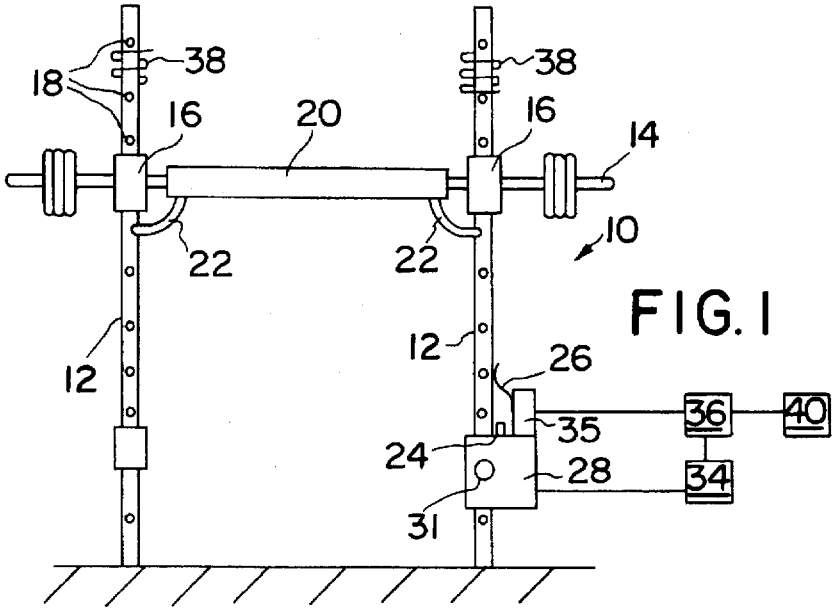
FIG. 1 shows the invention incorporating a Smith Machine.

Turning now to a discussion of the drawings, FIG. 1 shows a Smith machine 10 having a pair of uprights 12 and a weight bar 14 attached to a pair of collars 16. One collar 16 is slidably mounted on one upright and another collar is slidably mounted on the other upright. Each upright has a row of upright apertures 18. A sleeve 20 on weight bar 14 has a pair of detents 22, each of which engage an aperture 18 at any desired location along the bar when the athlete turns his wrist. The bar 14 can thereby be detachably fixed at any location along the bar 14 by the athlete rotating the sleeve.

A timer switch 24 and a counter switch 26 are both attached on one upright by a housing tube 28 that is slidably mounted on one upright. The housing tube 28 has a housing aperture in its side and a speed nut 31 is welded onto the housing tube concentric with the housing aperture. The housing tube can be fixed to the upright at any location by simply aligning the housing aperture with a desired upright aperture and inserting a speed bolt into the housing aperture and the selected upright aperture. The timer switch 24 is located on the housing tube at a position such that when the bottom end of the sleeve 16 rests on the top end of the housing tube 28, the timer switch 24 is depressed to an open condition. The counter switch 26 is located on an extension 35 of the housing tube 28 just above the timer switch 24. The counter switch 26 is spaced from the timer switch 24 such that, when the weight bar 14 returns toward home position, the counter switch 26 is momentarily closed to register a count without depressing the timer switch 24 which would reactivate the timer period. The normally closed timer switch 24 is connected to timer 34 which is connected in series with the counter switch 26 and a counter 36. The normally closed timer switch 24 is released when the athlete lifts the bar 14 from its rest position so that, every time the bar 14 returns to home position, where the counter switch 26 is momentarily closed, a count is registered.

The spacing of the counter switch 26 from the timer switch 24 is an important feature of the invention because the athlete must arrest the momentum of the returning bar and thereby generate ballistic force without contacting the timer switch which would otherwise absorb the momentum and defeat the object of the invention. Therefore, housing tube 28 has a variable extension 35 on which counter switch 26 is mounted and whose length can be adjusted to achieve a desired distance between the timer switch 24 and the counter switch 26.

A helical spring 38 is mounted on each upright 12 above and at an adjustable distance from the housing tube. The distance is preset such that, when the athlete propels the weight bar 14 upward, the bar 14 hits the spring 38 which is depressed and then recoils to propel the bar 14 back to home position. Therefore, the bar 14 conserves its upward momentum as opposed to the situation without the spring 38 in which case the bar 14 would simply fly higher and take longer to return to home position. Therefore, the spring 38 provides that, the faster the bar is propelled away from the user, the faster the bar returns to home position so that the number of counts during the timer period is a true measure of the ballistic force generated. In another variation, a second timer 40 displays the repetition time of each repetition as a motivation to the athlete to exercise harder.

Figure 2:
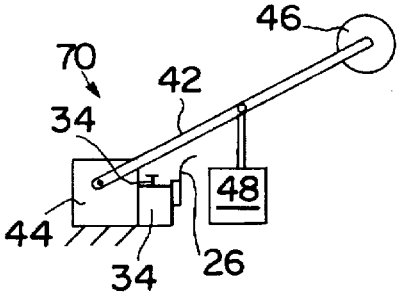
FIG. 2 shows the invention incorporating a leaper exerciser.

FIG.2 shows another embodiment of the invention incorporating a "leaper" exerciser 40. The leaper 40 includes a lever 42 rotatably attached at one end to a fulcrum base 44 and whose other end 46 is padded for contact with the shoulders of the user. A resistance means 48 is attached to the lever 42 intermediate the ends of the lever. The resistance means 48 can be any one of a number of devices well known in the an including a pneumatic device or weights. According to the embodiment of the invention, a normally closed timer switch 24 connected to timer 34 and is located where it is depressed when the lever 42 is in a rest position. A counter switch 26 is located such that, when the athlete starts his set of exercises by moving the lever 42 from the rest position, he releases the normally closed timer switch 24 and depresses the counter switch 26 every time the lever 42 returns to a "home" position near the "rest" position.

Figure 3:
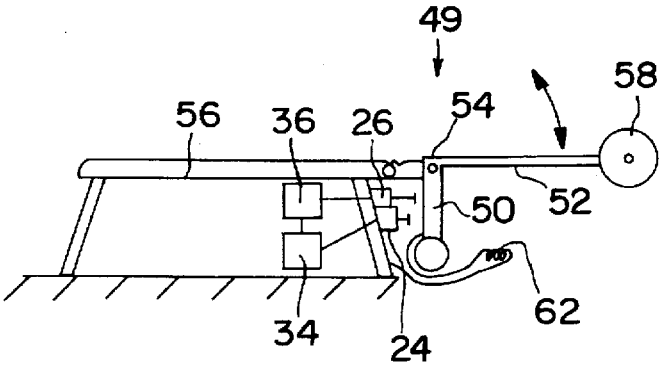
FIG. 3 shows the invention incorporating a knee extensor exerciser.

FIG. 3 shows another embodiment of the invention incorporating a knee extension exerciser 49. A ganged pair of levers 50 and 52 have a common end 54 rotatably mounted at an end of a bench 56. Weights 58 are detachably attached to ends of the levers 50 and 52. A timer switch 24 is positioned at a location on the bench 56 where the ganged levers 50 and 52 depress the timer switch 24 when the timer switch 24 is in "rest" position. The athlete lies on his back (or on his abdomen) on the bench 56 and hooks his ankle under an end of the lever 50 (or 52) and turns the levers by straightening (or bending his knee). A timer switch is positioned to be depressed when the levers 50 and 52 are in the rest position. When the levers 50 and 52 are rotated from the rest position, timer switch 24 is released initiating the timer period of timer 34. Every time the lever 50 returns to home position near rest position, counter switch 26 registers a count on counter 36. A spring 62 is attached between the end of lever 50 and the bench and the length of the spring attachment is adjustable such that when the lever is distal from the rest position, the spring is stretched causing the lever to reverse its direction of travel and return to the rest position without loss of momentum.

Figure 4:
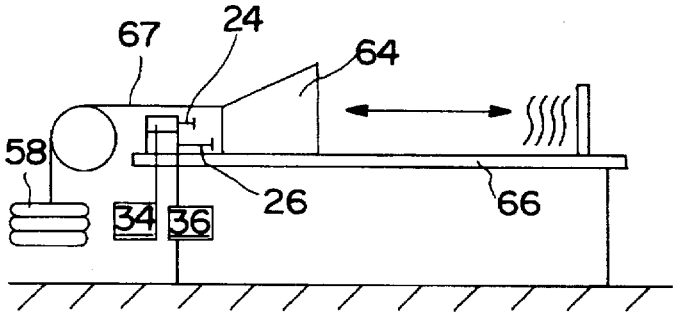
FIG. 4 shows the invention incorporating a sliding platform exerciser.

FIG. 4 shows another embodiment of the invention incorporating a platform 64 slidably mounted on a horizontal track 66. The track is attached at one end to an end of a cable 67 which engages a pulley 69 such that and other end of a cable is attached to a weight 58. The athlete stands on one leg next to the sliding platform and strokes the platform with the other leg thereby causing the sliding platform to move from a rest position. A normally closed timer switch 24 is depressed by the platform when the platform is in the rest position and is released when the athlete moves the platform to initiate the timer period. A counter switch 26 connected in series with the timer switch 24 counts a count every time the platform returns to a home position near the rest position at the end of a repetition during the timer period.

Other embodiments may be suggested by reading the specification and studying the drawings. For example, in place of a timer with a preset period, the timer switch 24 might be a "depress to close—depress to open" switch connected to a clock and the counter switch such that when the active member is first moved from the rest position, the clock is activated and remains activated while the number of repetitions (returns to home position) is counted and then is depressed again at rest position so that the clock records the length of time required to perform a given number of repetitions.

The exerciser need not be provided with weights or other biasing means to return the active member (e.g., bar ) to the home position and the rest position. For example, the knee extensor need not have weights 58 in which case the knee extensor with the switches, counter and timer of this invention is useful in timing simple calesthenic exercises of bending the knee.

In view of these and other variations, I therefore wish to define the scope of my invention by the appended claims.

I claim:

1. An exerciser for monitoring ballistic force, comprising:

a base means for supporting a user;

an active member movably mounted on said base means for movement by a user during exercise from a rest position in which the active member is at rest through a home position to an extended position;

a start switch for starting a timer when said active member is displaced from said rest position, said timer running for a timer period;

a counter switch connected in series with said start switch for incrementing a repetition counter when said active member passes through the home position toward the extended position;

means for adjusting the distance between the timer and counter switches; and a display for displaying the number of repetitions performed during the timer period.

2. The exerciser of claim 1 which comprises a spring return means for conserving momentum positioned at a location distal from said home position such that when a user thrusts said active member away from said rest position with sufficient force, said active member engages and compresses said spring return means and is urged by said spring return means to return toward said rest position.

3. The exerciser of claim 1 which comprises a biasing means which biases said active member toward said rest position for providing resistance to movement of said active member.

4. The exerciser of claim 3 in which said biasing means comprises a mass of said active member acted upon by gravity.

5. The exerciser of claim 4 wherein:

said base means comprises a pair of support bars adapted to be supported vertically with a supported end on a supporting surface;

said active member and further comprising is a weight bar slidably attached to said support bars;

a rest means adjustably attachable to a selected location on said support bars for supporting said weight bar when said weight bar is in said rest position.

6. The exerciser of claim 5 which comprises a spring return means slidably positionable on at least one said support bar such that when a user thrusts said bar upward with sufficient force, said weight bar engages and compresses said spring return means and is urged by said spring return means to return toward said rest position.

7. The exerciser of claim 3 wherein:

said base means is a track means adapted for being supported horizontally;

said active member is a sliding platform means slidable on said track means;

said biasing means has a flexible member having one end attached to said track means and another end attached to an adjustable weight operably constructed such that, when said user thrusts said platform means away from said rest position, said weight urges said track means to return toward said rest position.

8. The exerciser of claim 7 which comprises a spring return means positioned such that when said user displaces said sliding platform toward said extended position said sliding platform means engages and compresses said spring return means and momentum of said sliding platform is reversed toward said rest position.

9. The exerciser of claim 1 wherein:

said base means is a bench adapted for supporting said user lying on said bench;

said active member is a lever hinged at one end to an end of said bench adapted for receiving weights and permitting said user to hook said lever with his foot and rotate said lever such as to lift said weights from said rest position against gravity.

10. The exerciser of claim 9 which comprises a spring return means positioned such that when a user turns said lever it engages said spring return means and said lever means is urged by said spring return means to return toward said rest position.

* * * * *